US009349377B2

(12) United States Patent
Mano

(10) Patent No.: US 9,349,377 B2
(45) Date of Patent: May 24, 2016

(54) AUDIO ENCODING APPARATUS

(71) Applicant: RENESAS ELECTRONICS CORPORATION, Kanagawa (JP)

(72) Inventor: Ryuji Mano, Kanagawa (JP)

(73) Assignee: Renesas Electronic Corporation, Tokyo (JP)

( * ) Notice: Subject to any disclaimer, the term of this patent is extended or adjusted under 35 U.S.C. 154(b) by 650 days.

(21) Appl. No.: 13/706,448

(22) Filed: Dec. 6, 2012

(65) Prior Publication Data

US 2013/0185083 A1 Jul. 18, 2013

(30) Foreign Application Priority Data

Jan. 12, 2012 (JP) ..... 2012-004214

(51) Int. Cl.
*G10L 19/00* (2013.01)
*G10L 19/008* (2013.01)
*G10L 19/16* (2013.01)

(52) U.S. Cl.
CPC ..... *G10L 19/008* (2013.01); *G10L 19/167* (2013.01)

(58) Field of Classification Search
CPC ..... H04N 19/13; H04N 19/124; H04N 19/91; H04N 19/463; H04N 19/146; H04N 19/93; H04N 19/103; H04N 19/149; H04N 19/60; H04N 19/36; H03M 7/30; H03M 7/40; G06F 9/30014; G10L 19/002; G10L 19/032; G10L 19/18; G10L 19/20; G10L 19/22; G10L 15/26; G10L 15/30; G10L 19/008; G10L 25/78
USPC ..... 704/500–504; 375/245; 386/96; 700/94; 382/232
See application file for complete search history.

(56) References Cited

U.S. PATENT DOCUMENTS

2004/0008975 A1* 1/2004 Lin ..... 386/96
2006/0072836 A1* 4/2006 Chen et al. ..... 382/232
2006/0259168 A1* 11/2006 Geyersberger et al. ..... 700/94
2007/0036228 A1* 2/2007 Tseng ..... 375/245

FOREIGN PATENT DOCUMENTS

JP 8-331564 A 12/1996
JP 2006-190362 A 7/2006

OTHER PUBLICATIONS

Japanese Office Action received in corresponding Japanese Application No. 2012-004214 dated May 19, 2015.

* cited by examiner

*Primary Examiner* — Huyen Vo
(74) *Attorney, Agent, or Firm* — Mattingly & Malur, PC

(57) ABSTRACT

There is provided an audio encoding apparatus that can avoid that audio data becomes irreproducible after fast-forward play. A quantization unit quantizes and buffers audio data into a buffer unit. A stream generating unit puts buffered audio data in a frame where there is a header related to the audio data in a stream and/or in one or plural frames preceding that frame. As for a predetermined frame, the stream generating unit puts in a data field of the frame the whole of an audio data piece related to a header included in that frame and puts audio sample data following that audio sample in a remaining part of the data field. As for a frame not a predetermined one, it puts in a data field of the frame an audio data piece related to a header included in that frame and/or audio data pieces following that audio data piece.

11 Claims, 14 Drawing Sheets

AUDIO ENCODING APPARATUS

CROSS-REFERENCE TO RELATED APPLICATIONS

The disclosure of Japanese Patent Application No. 2012-004214 filed on Jan. 12, 2012 including the specification, drawings and abstract is incorporated herein by reference in its entirety.

BACKGROUND

The present invention relates to an audio encoding apparatus.

An audio encoding method that enables fast-forward play when reproducing data encoded by an MPEG (Moving Picture Expert Group) Audio Layer 3 (hereinafter referred to as MP3) method has heretofore been known.

For example, Patent Document 1 (Japanese Published Unexamined Patent Application No. 2006-190362) discloses an audio encoding method that quickly acquires information indicating a current play position and shortens a transition time from a normal play to a fast-forward or fast-backward play, and thus can avoid that a listener feels a temporary delay or stop in reproduction.

In this audio encoding method, an auxiliary data appender appends auxiliary data of 32×5 bits which are all defaulted to "0" to audio encoded data. An LBA writer overwrites a first 32-bit part of the auxiliary data with a value of LBA which is given by an LB counter. Further, a jump to position LBA writer overwrites the remaining parts of 32×4 bits with LBA_f4, LBA_f8, LBA_b4, and LBA_b8 to jump to which are given by the LB counter.

RELATED ART DOCUMENT

Patent Document

[Patent Document 1] Japanese Published Unexamined Patent Application No. 2006-190362

SUMMARY

However, there is a possibility that data encoded by the encoding method of related art, as in Patent Document, becomes irreproducible for several seconds after fast-forward play (fast forwarding of frames). For example, when a sampling frequency is 24 KHz, the size of a frame is 24 bytes, the size of main_data within a frame is 1 byte, the size of audio data is 576 bytes, and main_data_begin indicates a maximum, given that the number of preceding frames is 256 frames, theoretically, there is a possibility that encoded data becomes irreproducible for 6.1 seconds.

In consequence, reproduction stops for several seconds. This phenomenon occurs in a case that a previous frame is missing in streaming data buffered in a memory in real-time streaming reproduction.

Therefore, an object of the present invention is to provide an audio encoding apparatus that can avoid that audio data becomes irreproducible after fast-forward play.

An audio encoding apparatus in one aspect of the present invention includes a quantization unit that quantizes audio data, a buffer unit that buffers quantized audio data, and a stream generating unit that puts quantized audio data from the buffer unit in a frame where there is a header related to the audio data in a stream and/or in one or plural frames preceding the frame where there is the header. As for a predetermined frame, the stream generating unit puts in a data field of the frame the whole of an audio data piece related to a header included in that frame and puts audio data pieces following that audio data piece as much as possible in a remaining part of the data field of the frame and, as for a frame other than a predetermined frame, the stream generating unit puts in a data field of the frame an audio data piece related to a header included in that frame and/or audio data pieces following that audio data piece.

According to the audio encoding apparatus in one aspect of the present invention, it is possible to avoid that audio data becomes irreproducible after fast-forward play.

DETAILED DESCRIPTION

Embodiments of the present invention will be described below with reference to the drawings.

First Embodiment

Figure 1:
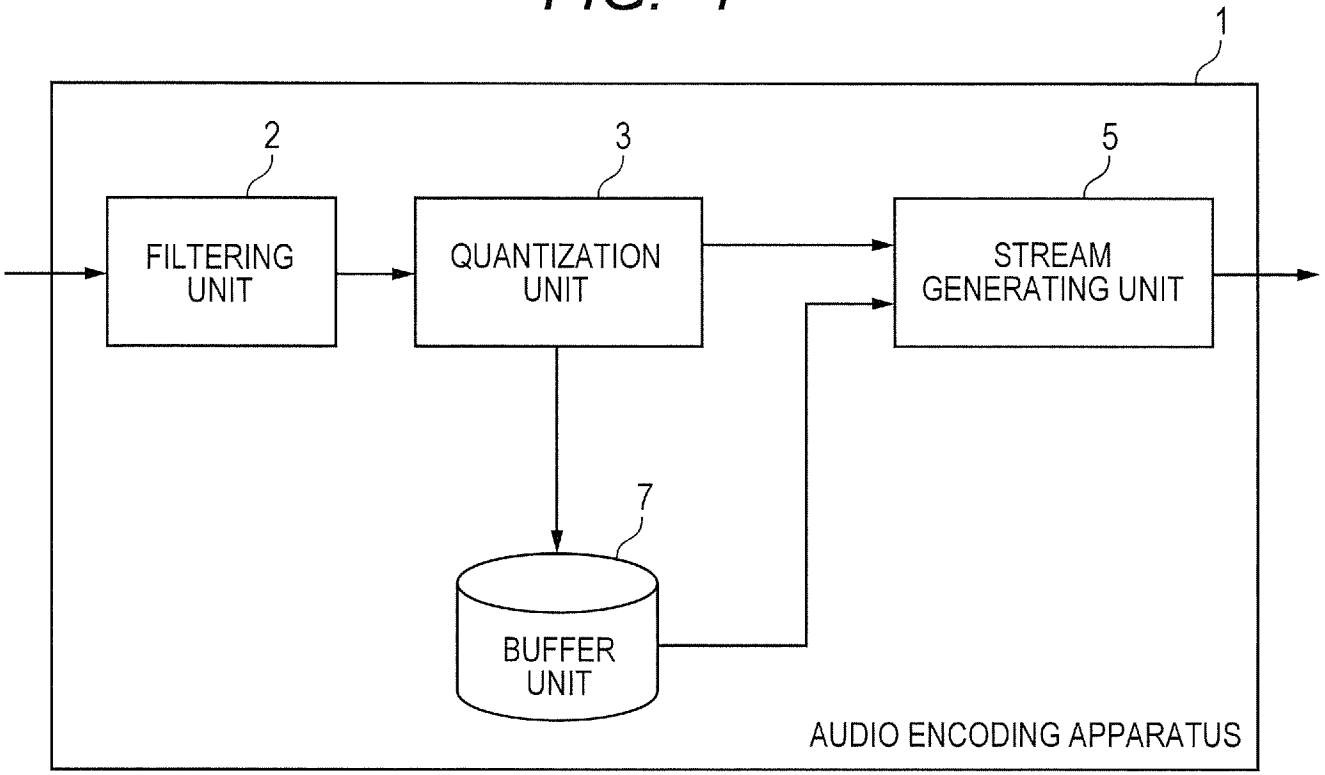
FIG. 1 is a diagram depicting a configuration of an audio encoding apparatus according to a first embodiment.

FIG. 1 is a diagram depicting a configuration of an audio encoding apparatus according to a first embodiment.

Referring to FIG. 1, this audio encoding apparatus 1 includes a filtering unit 2, a quantization unit 3, a buffer unit 7, and a stream generating unit 5.

The filtering unit 2 divides 1152 pieces of audio data sampled for every given period of time into subband signals, converts these signals into an MDCT (Modified Discrete Cosine Transform) spectrum, and eliminates folding noise in a frequency domain by folding distortion (aliasing) reduction butterfly.

The quantization unit 3 quantizes audio data comprised of 1152 pieces of filtered audio samples which are output from the filtering unit 2 and stores the quantized audio data into the buffer unit 7. That is, in the quantization unit 3, under constraints of a requirement in respect of permissible quantization noise power per frequency band calculated by a psychological auditory analyzer, a bit rate, and the number of available bits, which is determined based on the number of bits accumulated in a bit reservoir (by which a pseudo variable bit rate is implemented), a scale factor is determined by changing the quantization step size and the number of quantization bits per frequency band by iterative loop processing, an MDCT spectrum is quantized, and Huffman coding of quantization indexes is performed. The quantization unit 3 generates a header and additional information and sends these to the stream generating unit 5.

The buffer unit 7 buffers audio data quantized by the quantization unit 3. The stream generating unit 5 retrieves quantized audio data main_data from the buffer unit 7, adds a header and additional information to it, and generates a stream of MPEG Audio Layer 3. Frames in a stream of MPEG Audio Layer 3 are of equal length, each frame includes a header and additional information, and main_data is put in a main data field.

Additional information includes information about an MDCT converted block length, a quantization step size, scale factor related information, information about a Huffman coding region and table, main_data_begin, etc.

In each frame, main_data_begin represents a length (excluding a header and additional information) between the beginning position of the frame and the beginning position of main_data related to the header of the frame. Thus, if main_data_begin is "0", it indicates that main_data related to the header of the frame exists within that frame. If main_data_begin is other than "0", it indicates that main_data related to the header of the frame exists within a frame preceding that frame.

The stream generating unit 5 puts (packages) quantized audio data from the buffer unit 7 in a frame where there is a header related to the audio data in a stream and/or in one or plural frames preceding the frame where there is the header. That is, since a header related to an i-th piece of audio data is put in an i-th frame in a stream, the stream generating unit puts (packages) the i-th piece of audio data in the i-th frame and/or in one or plural frames preceding the i-th frame.

More specifically, as for a predetermined frame, the stream generating unit 5 puts in a data field of the frame the whole of an audio data piece related to a header included in that frame and puts audio data pieces following that audio data piece as much as possible in a remaining part of the data field of the frame within an upper limit. For example, if a predetermined frame is a third frame, the whole of a third piece of audio data related to a header included in the third frame is put in the data field of the third frame and fourth and subsequent pieces of audio data are put as much as possible in a remaining part of the data field of the third frame within an upper limit. Here, the upper limit is defined as: for example, among all bits constituting an X-th piece of audio data, a maximum amount of bits that can be put in one or more frames preceding the X-th frame.

As for a frame other than a predetermined frame, the stream generating unit 5 puts in a data field of the frame an audio data piece related to a header included in that frame and/or audio data pieces following that audio data piece. Again, audio data pieces that follow are to be put in the data field of the frame within the upper limit. For example, if a frame other than a predetermined frame is a fourth frame, a fourth piece of audio data related to a header included in the fourth frame and/or fifth and subsequent pieces of audio data are put in the data field of the fourth frame. Therefore, in some cases, a part or the whole of the fourth piece of audio data may not be included in the fourth frame.

In the first embodiment, a predetermined frame shall exist cyclically as the first one of a given number of successive frames (for example, three successive frames).

The stream generating unit 5 puts main_data_begin that represents "0" in a predetermined frame.

The stream generating unit 5 pads an empty portion not filled with audio data within a main data field in a frame with zeros (zero padding). An empty portion of the data field results from a restriction that audio data pieces that follow are allowed to be put in the data field within the upper limit, as mentioned above. It is also due to the fact that main_data_begin in a predetermined field is "0" and thus audio data pieces related to headers included in the predetermined frame and subsequent frames cannot be put in a frame that precedes the predetermined frame.

Figure 2:
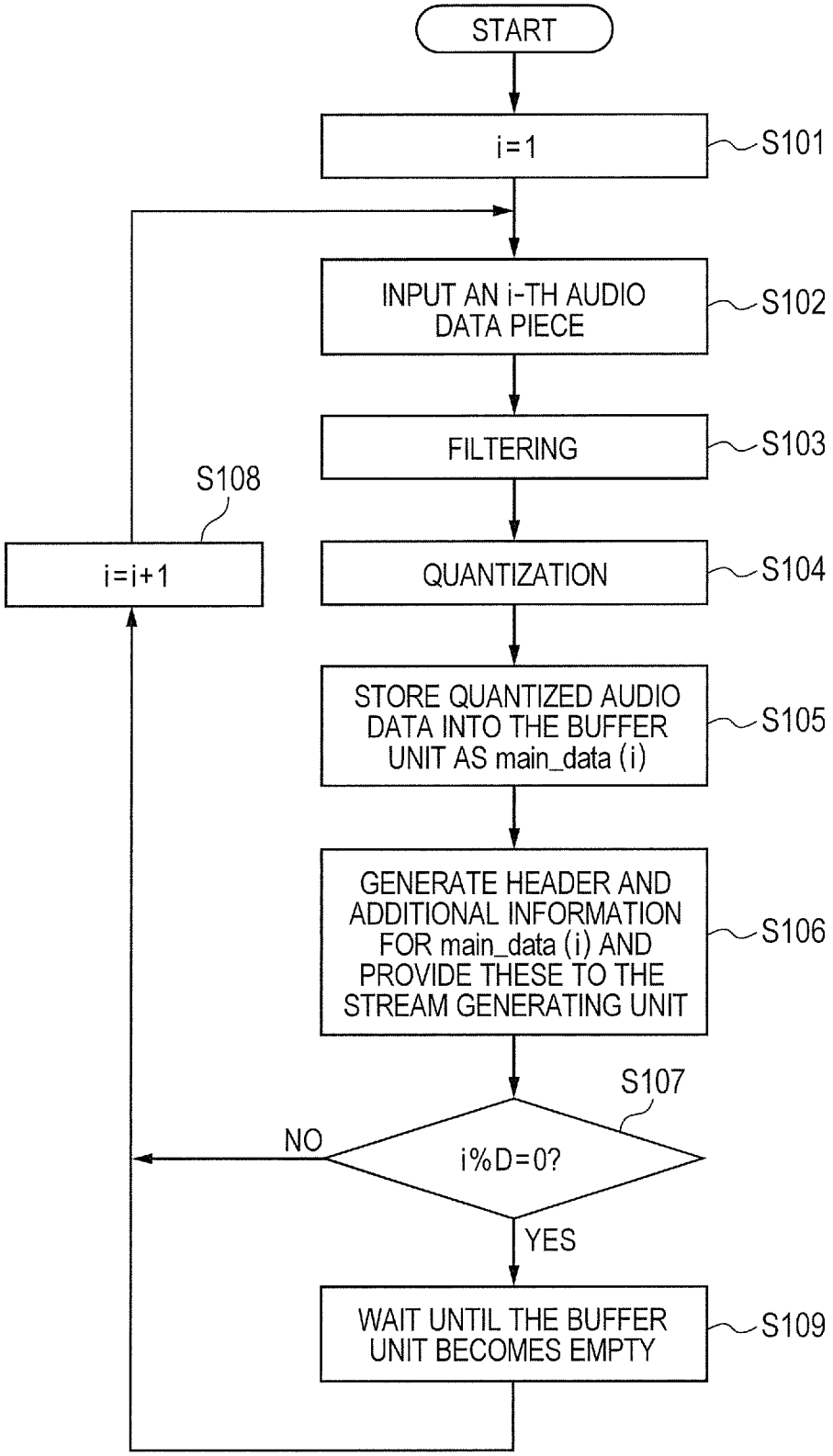
FIG. 2 is a flowchart illustrating an operation procedure of a filtering unit and a quantization unit of the audio encoding apparatus according to the first embodiment.

FIG. 2 is a flowchart illustrating an operation procedure of the filtering unit and the quantization unit of the audio encoding apparatus according to the first embodiment.

Referring to FIG. 2, first, audio data number i is set to "1" (step S101).

Then, an audio data piece of number i is input to the filtering unit 2 (step S102).

Then, the filtering unit 2 performs filtering (step S103). Next, the quantization unit 3 quantizes filtered audio data. Specifically, if dividing audio data number i by the number of successive frames in a cycle D yields a remainder of "1", the quantization unit 3 quantizes the audio data by adjusting the quantization scale so that the amount of quantized data does not exceed capacity A of the main data field in a frame of number i.

Otherwise, if dividing audio data number i by the number of successive frames in a cycle D yields a remainder that is not "1", the quantization unit 3 quantizes the audio data by adjusting the quantization scale so that the amount of quantized data does not exceed a total (A+B) of the capacity A of the main data field in a frame of number i and the sum in size of empty portions of main data fields in one or more given frames preceding the frame of number i or a predetermined upper limit which is smaller (B). Here, the one or more given frames are a frame for which dividing its frame number by the number of successive frames in a cycle D yields a remainder of "1" and frames ranging from a frame number (i−D) to a frame number (i−1) (step S104).

Then, the quantization unit 3 stores the quantized audio data into the buffer unit 7 as main_data (i) (step S105).

Then, the quantization unit 3 generates a header and additional information for main_data (i) and provides these to the stream generating unit 5. Here, if dividing audio data number i by the number of successive frames in a cycle D yields a remainder of "1", the quantization unit 3 sets main_data_begin (j), which is a part of additional information, to "0". If dividing audio data number by the number of successive frames in a cycle D yields a remainder that is not "1", the quantization unit 3 assigns the length between the beginning of the frame of number i in the stream and the beginning position of main_data (i) (excluding additional information and a header) to a value of main_data_begin (i) which is apart of additional information. Also, the quantization unit 3 provides information as to how much portion of main_data (i) should be put in each frame preceding the frame of number i (allocation information) to the stream generating unit 5 (step S106).

Next, if dividing audio data number i by the number of successive frames in a cycle D yields a remainder of "0" (YES as decided at step S107), the process waits until the buffer unit 7 becomes empty, when the buffered audio data has been consumed by the stream generating unit 5 (step S109). After that, audio data number is incremented by one (step S108) and the process from step S102 is repeated.

Otherwise, if dividing audio data number i by the number of successive frames in a cycle D yields a remainder that is not "0" (NO as decided at step S107), audio data number i is incremented by one (step S108) without waiting until the buffer unit 7 becomes empty and the process from step S102 is repeated.

Figure 3:
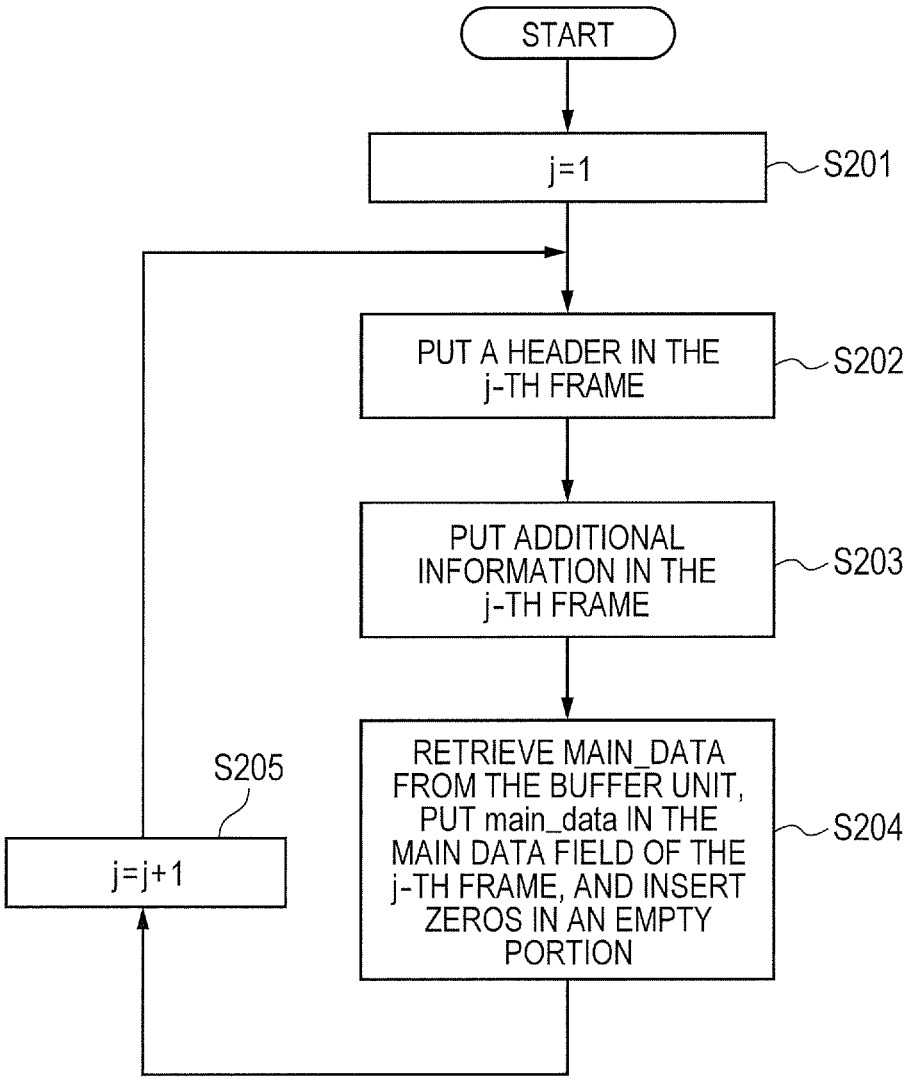
FIG. 3 is a flowchart illustrating an operation procedure of a stream generating unit of the audio encoding apparatus according to the first embodiment.

FIG. 3 is a flowchart illustrating an operation procedure of the stream generating unit of the audio encoding apparatus according to the first embodiment.

First, frame number j is set to "1" (step S201). Then, the stream generating unit 5 puts a header for main_data (j) created by the quantization unit 3 in a header field of the frame of number j (step S202).

Then, the stream generating unit 5 puts additional information for main_data (j) created by the quantization unit 3 in an additional information field of the frame of number j (step S203).

Then, based on allocation information created by the quantization unit 3, the stream generating unit 5 sequentially retrieves main_data as much as the capacity A of a main data field of the frame of number j from the buffer unit 7 and puts the main_data in the main data field, thus generating the frame. If there remains an empty portion in the main data field, the stream generating unit 5 pads the empty portion with zeros (zero padding) (step S204).

Next, frame number j is incremented by one (step S205) and the process from step S202 is repeated.

Figure 4:
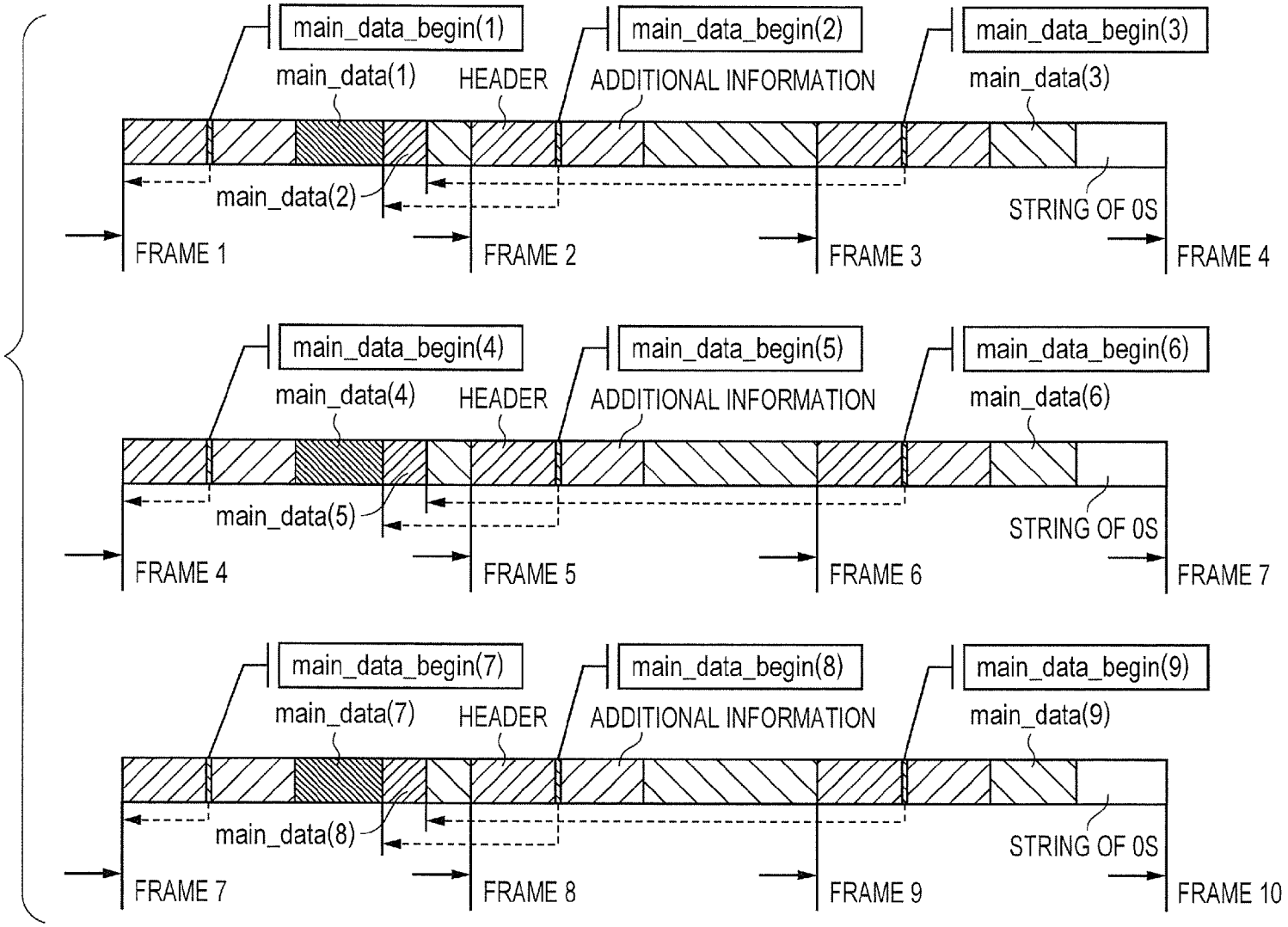
FIG. 4 is a diagram showing an example of a stream that is generated by the audio encoding apparatus according to the first embodiment.

(Stream example) FIG. 4 is a diagram showing an example of a stream that is generated by the audio encoding apparatus according to the first embodiment.

FIG. 4 shows a stream example in a case where the number of successive frames in a cycle D is "3". In frames 1, 4, and 7, main_data_begin is set to "0".

All of main_data (1) is put in the main data field of frame 1 and all of main_data (2) that follows and a part of main_data (3) that follows are put in the remaining part of the main data field. In this example, it is assumed that the following restriction is satisfied: the amount of all of main_data (2) and a part of main_data (3) put in frame 1 should not exceed the upper limit.

A part of main_data (3) is put in the main data field of frame 2. In this example, it is assumed that the following restriction is satisfied: the amount of a part of main_data (3) put in frame 2 should not exceed the upper limit.

A part of main_data (3) is put in the main data field of frame 3. An empty portion of the main data field of frame 2 is padded with zeros.

All of main_data (4) is put in the main data field of frame 4 and all of main_data (5) that follows and a part of main_data (6) that follows are put in the remaining part of the main data field. In this example, it is assumed that the following restriction is satisfied: the amount of all of main_data (5) and a part of main_data (6) put in frame 4 should not exceed the upper limit.

A part of main_data (6) is put in the main data field of frame 5. In this example, it is assumed that the following restriction is satisfied: the amount of a part of main_data (6) put in frame 5 should not exceed the upper limit.

A part of main_data (6) is put in the main data field of frame 6. An empty portion of the main data field of frame 6 is padded with zeros.

All of main_data (7) is put in the main data field of frame 7 and all of main_data (8) that follows and a part of main_data (9) that follows are put in the remaining part of the main data field. In this example, it is assumed that the following restriction is satisfied: the amount of all of main_data (8) and a part of main_data (9) put in frame 7 should not exceed the upper limit.

A part of main_data (9) is put in the main data field of frame 8. In this example, it is assumed that the following restriction is satisfied: the amount of a part of main_data (9) put in frame 8 should not exceed the upper limit.

A part of main_data (9) is put in the main data field of frame 9. An empty portion of the main data field of frame 9 is padded with zeros.

As above, according to the present embodiment, by placing frames in which main_data_begin is 0 to come cyclically as the first one of a given number of successive frames in a cycle, it is possible to avoid that audio data becomes irreproducible after fast-forward play.

It was stated in the present embodiment that the process waits until the buffer unit 7 becomes empty at step S109 in FIG. 2, but there is no limitation to this. Buffering quantized audio data may be continued without waiting until the buffer unit 7 becomes empty. The buffer unit 7 may be cleared when i % D=0 has been fulfilled and then quantized data may be buffered again.

Second Embodiment

Figure 5:
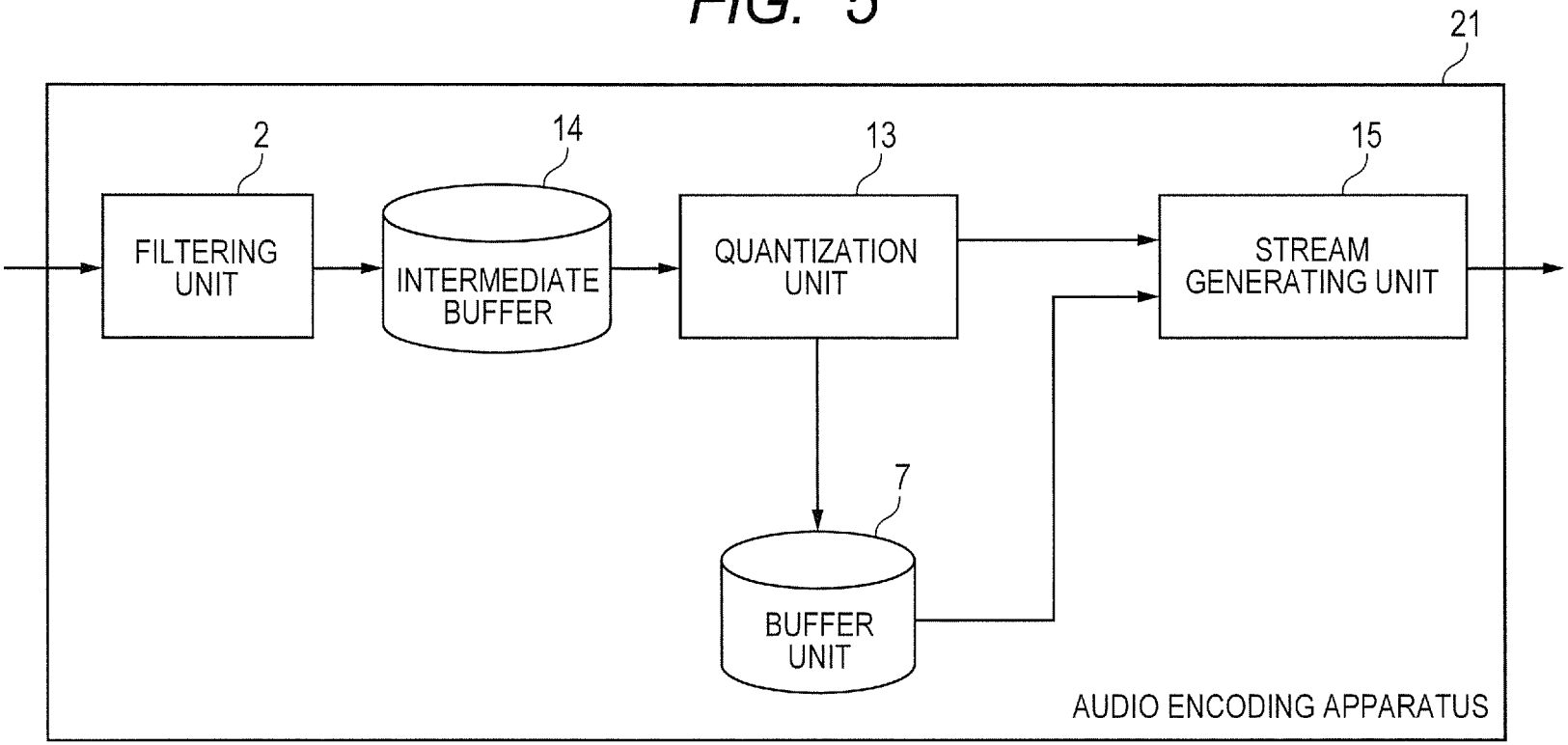
FIG. 5 is a diagram depicting a configuration of an audio encoding apparatus according to a second embodiment.

FIG. 5 is a diagram depicting a configuration of an audio encoding apparatus according to a second embodiment.

Referring to FIG. 5, this audio encoding apparatus 21 includes an intermediate buffer 14 in addition to the configuration of the audio encoding apparatus 1 of the first embodiment.

In the first embodiment, it was stated that the stream generating unit 5 pads an empty portion not filled with audio data in a main data field with zeros (zero padding).

On the other hand, in the present embodiment, a quantization unit 13 adjusts the quantization scale of audio data so that no empty portion is produced in a main data field. For the purpose of this adjustment, the intermediate buffer 14 is used.

Besides, in the present embodiment, the quantization unit 13 divides frames in a stream into frame blocks. The number of frames included in a frame block is uneven. The quantization unit 13 sets the leading frame of one frame block as a predetermined frame.

The quantization unit 13 sets the origin of a block at a first frame which is next to the last frame of the previous frame block and sequentially selects subsequent frames. The quantization unit 13 calculates a difference between the capacity A of a main data field in a frame and the amount of quantized audio data related to a header included in the selected frame.

The quantization unit 13 determines a frame for which the sum of differences mentioned above, accumulated for sequentially selected frames, will exceed an allowable buffer capacity which has been set beforehand or a next frame after selecting a given number of frames as a predetermined frame (leading frame) that should exist in the next frame block.

The quantization unit 13 determines a frame that precedes the above predetermined frame as a second frame and sets frames from the first frame to the second frame as the current frame block.

Figure 6:
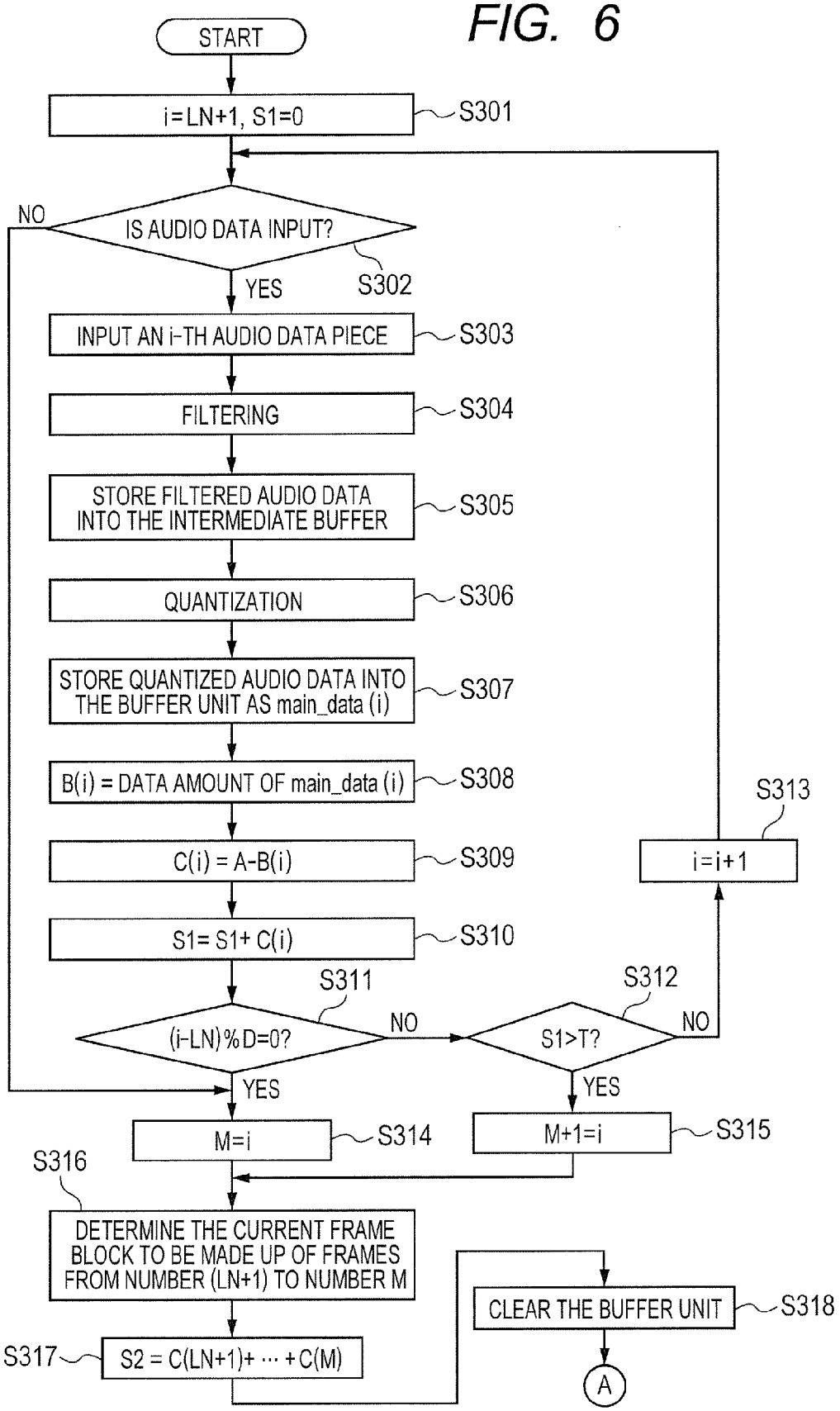
FIG. 6 is a flowchart illustrating a procedure for processing one frame block by the filtering unit and quantization unit of the audio encoding apparatus according to the second embodiment.
Figure 7:
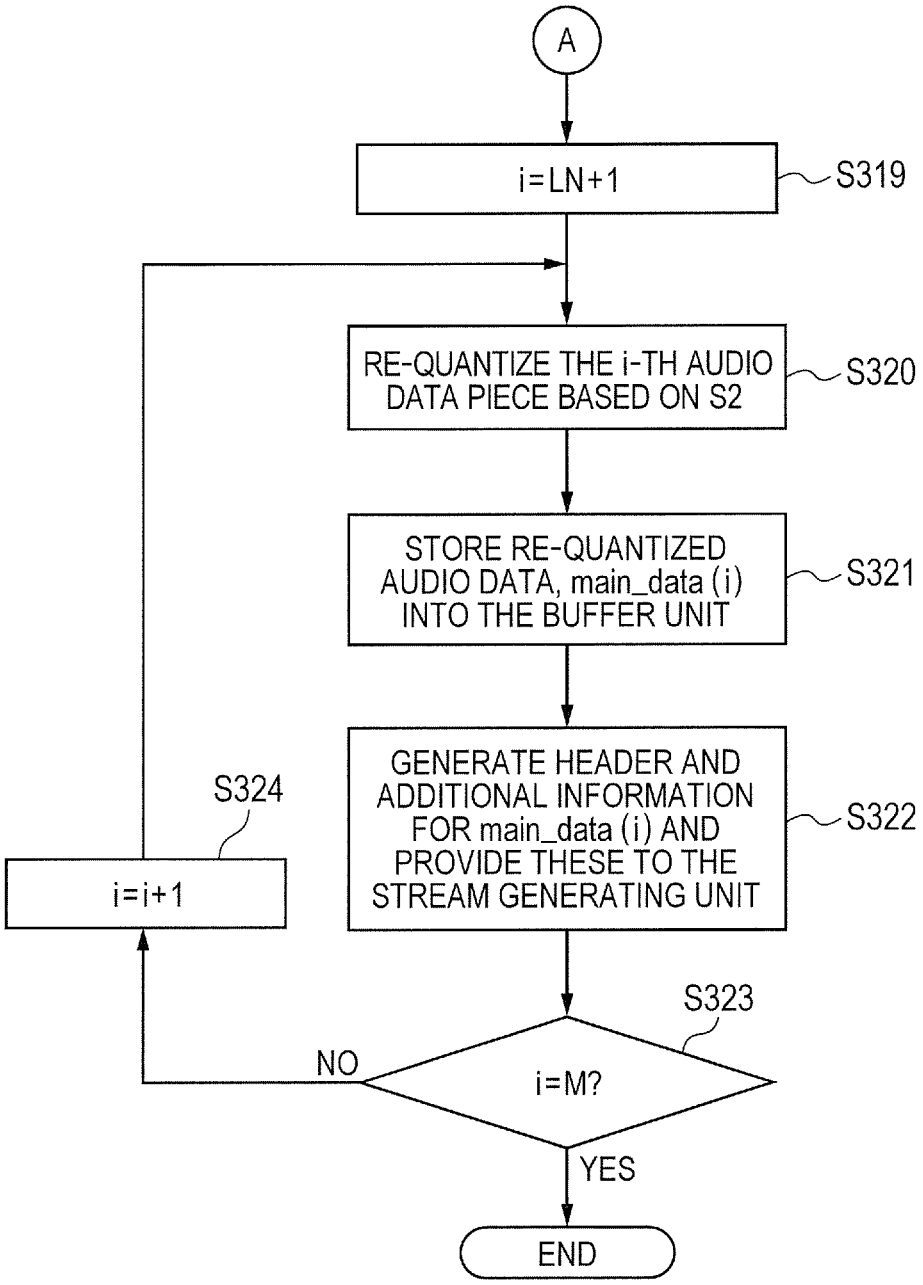
FIG. 7 is a flowchart illustrating a procedure for processing one frame block by the filtering unit and quantization unit of the audio encoding apparatus according to the second embodiment.

FIGS. 6 and 7 are flowcharts illustrating a procedure for processing one frame block by the filtering unit and quantization unit of the audio encoding apparatus according to the second embodiment.

First, the quantization unit 13 assigns a value of 1 added to the last audio data number LN of the previous frame block to audio data number i and sets S1 to 0 (step S301).

Then, if audio data is input (YES as decided at step S302), an audio data piece of number i is input to the filtering unit 2 (step S303).

Then, the filtering unit 2 performs filtering (step S304) and filtered audio data is buffered into the intermediate buffer 14 (step S305).

Then, the quantization unit 13 retrieves data from the intermediate buffer 14 and performs quantization of the data (step S306).

Next, the quantization unit 13 stores the quantized audio data into the buffer unit 7 as main_data (i) (step S307).

Then, the quantization unit 13 assigns the data amount of main_data (i) to data amount B(i) (step S308).

Next, the quantization unit 13 assigns a value yielded by subtracting the value of B(i) from the capacity A of a main data field to difference value C(i) (step S309).

Then, the quantization unit 13 adds the difference value C (i) obtained at the previous step S309 to the difference sum value S1 (step S310).

If dividing (i−LN) by the number of successive frames in a cycle D yields a remainder that is not "0" (NO as decided at step S311) and if the difference sum value S1 is less than the allowable buffer capacity T which has been set beforehand (NO as decided at step S312), audio data number i is incremented by one (step S313) and the process from step S302 is repeated.

If dividing (i−LN) by the number of successive frames in a cycle D yields a remainder of "0" (YES as decided at step S311) or if next audio data is not input (NO as decided at step S302), the quantization unit 13 assigns a value of i to a variable M (step S314).

If the difference sum value S1 exceeds the allowable buffer capacity T which has been set beforehand (YES as decided at step S301), the quantization unit 13 assigns a value of i to a variable (M+1) (step S315).

Here, instead of determining a frame for which the difference sum value accumulated for sequentially selected frames will exceed the allowable buffer capacity T which has been set beforehand, the quantization unit 13 may determine a next frame after selecting a given number of frames as a predetermined frame (leading frame) that should exist in the next frame block.

Then, the quantization unit 13 sets a frame of number (M+1) as the leading frame (first frame) of the next frame block and a frame of number M as the second frame. The quantization unit 13 determines the current frame block to be made up of frames from number (LN+1) to number M. That is, frames from the first frame to the second frame are set belonging to the current frame block (step S316).

Next, the quantization unit 13 assigns difference values C(LN+1)+ . . . +C(M) to S2 as information for new difference values (step S317).

Then, the quantization unit 13 clears the buffer unit 7 (step S318). Next, a value of 1 added to LN is assigned to audio data number i (step S319).

Then, the quantization unit 13 retrieves the i-th audio data piece which has been filtered from the intermediate buffer 14 and re-quantizes it. As is the case for the first embodiment, if dividing audio data number i by the number of successive frames in a cycle D yields a remainder of "1", the quantization unit 13 quantizes the audio data by adjusting the quantization scale so that the amount of quantized data does not exceed the capacity A of the main data field in a frame of number i. If dividing audio data number i by the number of successive frames in a cycle D yields a remainder that is not "1", the quantization unit 13 quantizes the audio data by adjusting the quantization scale so that the amount of quantized data does not exceed a total (A+B) of the capacity A of the main data field in a frame of number i and the sum in size of empty portions of main data fields in one or more given frames preceding the frame of number i or a predetermined upper limit which is smaller (B). For example, if a difference value (i+1) is positive and a difference value C (i) is negative, the size B that is available for the i-th data piece is increased within the upper limit and the increased size is deducted for the (i+1)-th data piece. Or, the size B appropriate for each frame number is controlled so that there will be no negative amount of allocation for audio data numbers from LN+1 to M or a negative amount of allocation will be compensated by all positive amounts of allocation depending on the difference value C. Here, the above-mentioned one or more given frames are a frame for which dividing its frame number by the number of successive frames in a cycle D yields a remainder of "1" and frames ranging from a frame number (i−D) to a frame number (i−1). Moreover, in the second embodiment, the quantization unit 13 performs re-quantization by adjusting the quantization scale based on the difference sum value S2, so that an empty portion of a data field, as described for the first embodiment, is not produced (step S320).

Then, the quantization unit 13 stores the re-quantized audio data into the buffer unit 7 as main_data (i) (step S321).

Then, the quantization unit 13 generates a header and additional information for main_data (i) and provides these to the stream generating unit 15. Here, if i is (LN+1), the quantization unit 13 sets main_data_begin (j), which is a part of additional information, to "0". If i is not (LN+1), the quantization unit 13 assigns the length between the beginning of the frame of number i in the stream and the beginning position of main_data (i) (excluding additional information and a header) to a value of main_data_begin (i) which is a part of additional information. Also, the quantization unit 13 provides information as to how much portion of main_data (i) should be put in each frame preceding the frame of number i (allocation information) to the stream generating unit 15 (step S322).

Audio data number i is incremented by one (step S324) until audio data number i becomes M (YES as decided at step S323) and the process from step S320 is repeated.

Figure 8:
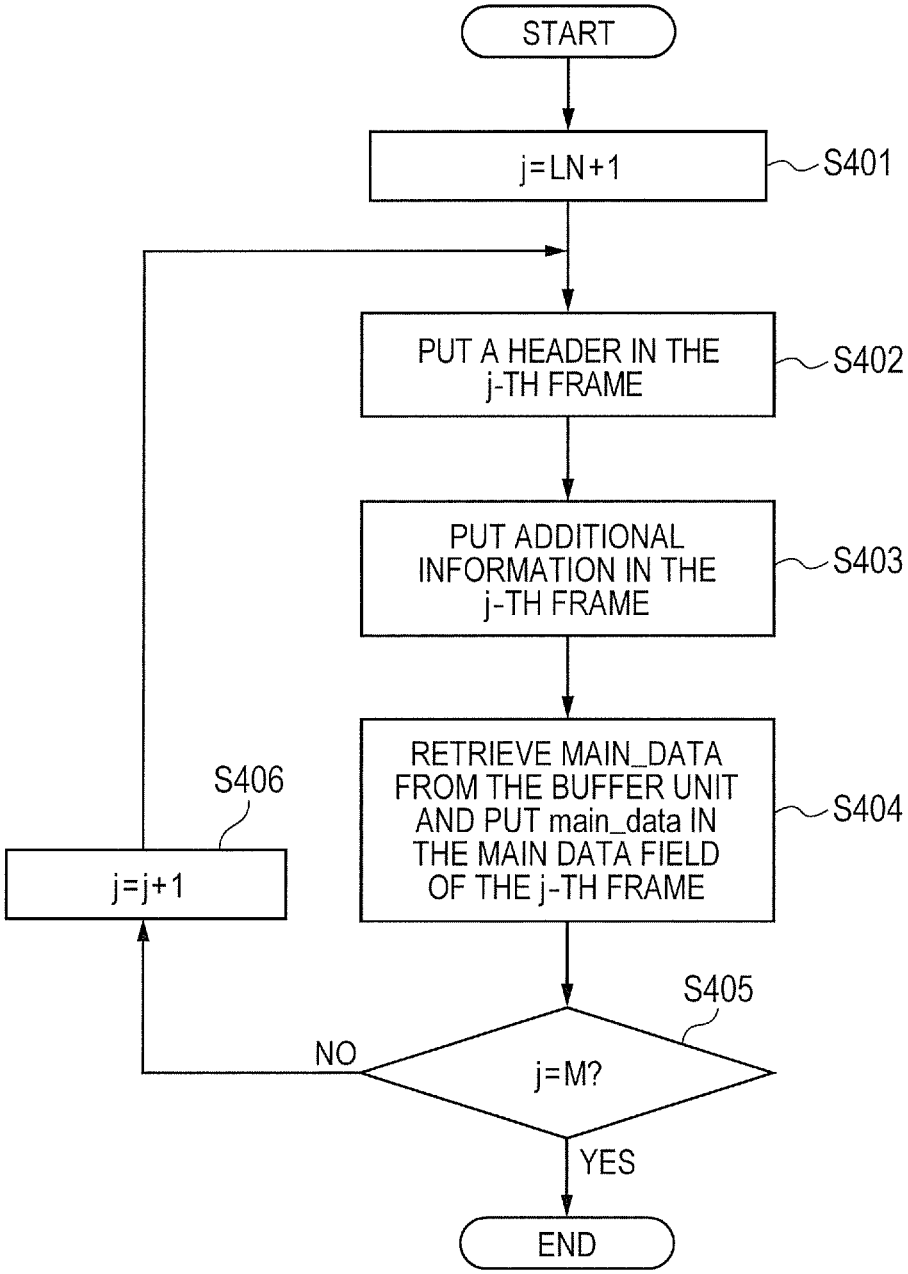
FIG. 8 is a flowchart illustrating a procedure for processing one frame block by the stream generating unit of the audio encoding apparatus according to the second embodiment.

FIG. 8 is a flowchart illustrating a procedure for processing one frame block by the stream generating unit of the audio encoding apparatus according to the second embodiment.

First, the stream generating unit 15 assigns a value of 1 added to the last audio data number LN of the previous frame block to frame number j. A frame of number (LN+1) is set as a first frame (step S401).

Then, the stream generating unit 15 puts a header for main_data (i) created by the quantization unit 13 in a header field of the frame of number j (step S402).

Then, the stream generating unit 15 puts additional information for main_data (j) created by the quantization unit 13 in an additional information field of the frame of number j (step S403).

Then, the stream generating unit 15 retrieves main_data as much as the capacity A of a main data field of the frame of number j from the buffer unit 7 and puts the main_data in the main data field (step S404).

After that, frame number j is incremented by one (step S406) and the process from step S402 is repeated.

Figure 9:
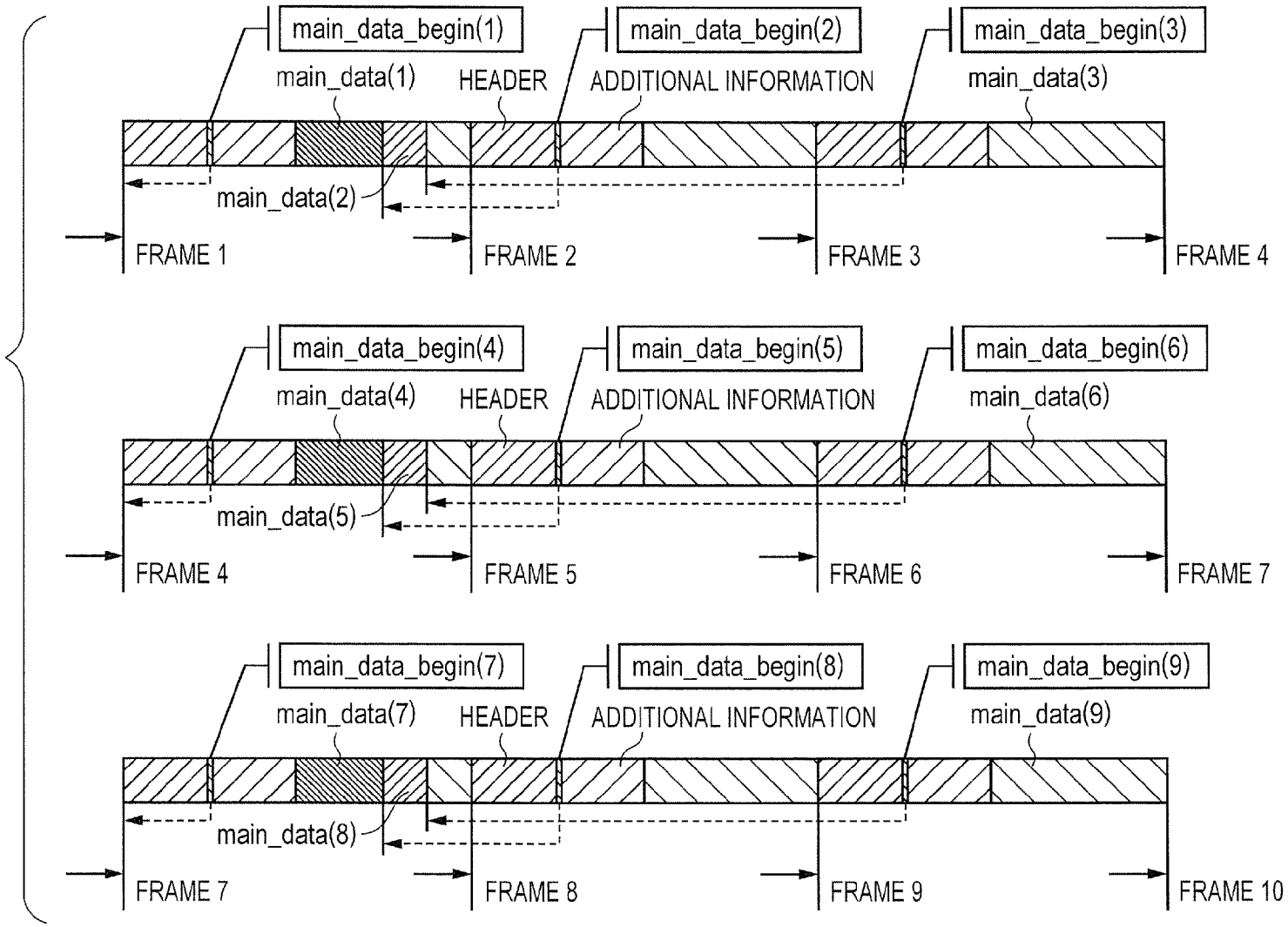
FIG. 9 is a diagram showing an example of a stream that is generated by the audio encoding apparatus according to the second embodiment.

(Stream example) FIG. 9 is a diagram showing an example of a stream that is generated by the audio encoding apparatus according to the second embodiment.

In the first embodiment, frames 3, 6, and 9 are padded with zeros as shown in FIG. 4, whereas, in the present embodiment, there is no frame padded with zeros, because the quantization scale of audio data is adjusted so that no empty portion is produced in a main data field.

As above, according to the present embodiment, it is possible to enhance audio quality by preventing an empty portion of a data filed from being produced in a frame that precedes a frame in which main_data_begin is 0.

[Example of modification to the second embodiment] In this example of modification, among a first frame which is next to the last frame of the previous frame block and a given number of subsequent frames, the quantization unit 13 sets a frame for which the size of quantized audio data related to a header included in the frame is smallest as a predetermined frame that should exist in the next frame block. The quantization unit 13 determines a frame that precedes the above predetermined frame as a second frame and sets frames from the first frame to the second frame as the current frame block.

Figure 10:
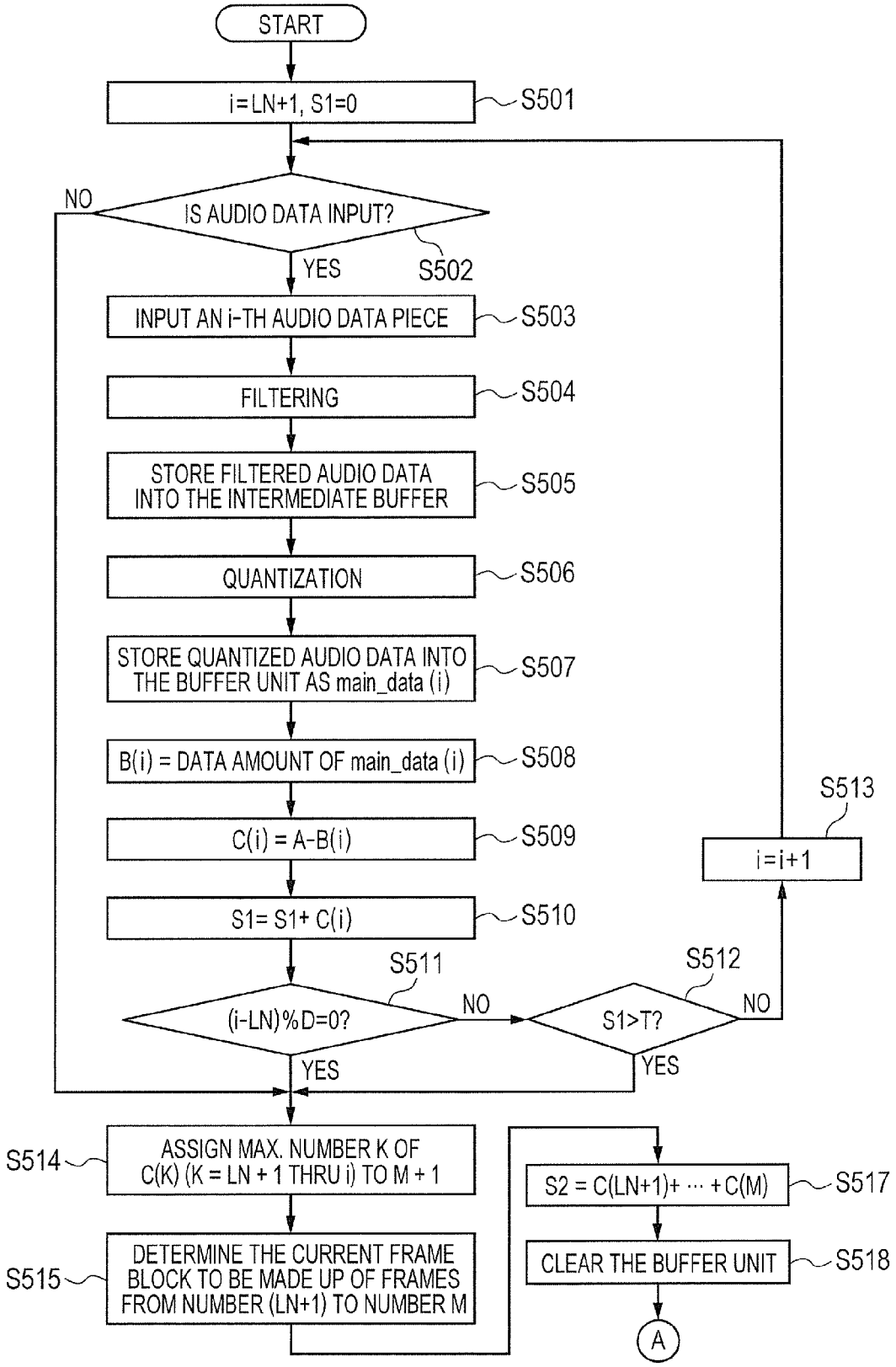
FIG. 10 is a flowchart illustrating a procedure for processing one frame block by the filtering unit and quantization unit of the audio encoding apparatus according to an example of modification to the second embodiment.
Figure 11:
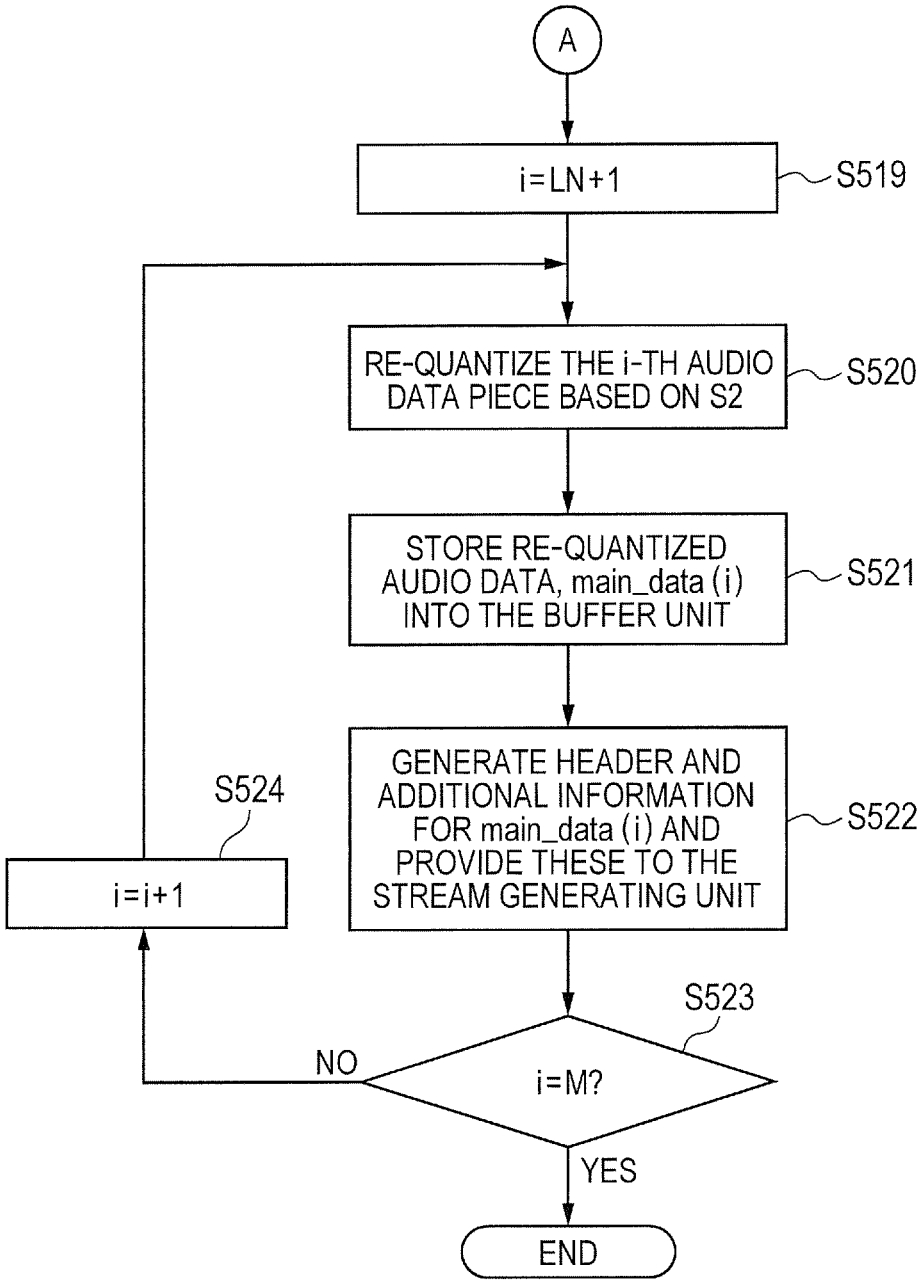
FIG. 11 is a flowchart illustrating a procedure for processing one frame block by the filtering unit and quantization unit of the audio encoding apparatus according to the example of modification to the second embodiment.

FIGS. 10 and 11 are flowcharts illustrating a procedure for processing one frame block by the filtering unit and quantization unit of the audio encoding apparatus according to the example of modification to the second embodiment.

First, the quantization unit 13 assigns a value of 1 added to the last audio data number LN of the previous frame block to audio data number i and sets S1 to 0 (step S501).

Then, if audio data is input (YES as decided at step S502), an audio data piece of number i is input to the filtering unit 2 (step S503).

Then, the filtering unit 2 performs filtering (step S504) and filtered audio data is buffered into the intermediate buffer 14 (step S505).

Then, the quantization unit 13 retrieves data from the intermediate buffer 14 and performs quantization of the data (step S506).

Next, the quantization unit 13 stores the quantized audio data into the buffer unit 7 as main_data (i) (step S507).

Then, the quantization unit 13 assigns the data amount of main_data (i) to data amount B(i) (step S508).

Next, the quantization unit 13 assigns a value yielded by subtracting the value of B (i) from the capacity A of a main data field to difference value C(i) (step S509).

Then, the quantization unit 13 adds the difference value C (i) obtained at the previous step S509 to the difference sum value S1 (step S510).

If dividing (i−LN) by the number of successive frames in a cycle D yields a remainder that is not "0" (NO as decided at step S511) and if the difference sum value S1 is less than the capacity T of the buffer unit 7 (NO as decided at step S512), audio data number is incremented by one (step S513) and the process from step S502 is repeated.

If dividing (i−LN) by the number of successive frames in a cycle D yields a remainder of "0" (YES as decided at step S511), or if next audio data is not input (NO as decided at step S502), or if the difference sum value 51 exceeds the capacity T of the buffer unit 7 (YES as decided at step S512), the quantization unit 13 finds a maximum number k of C (k) (k=LN+1 thru i) and assigns the found maximum number k to a variable (M+1) (step S514).

Then, the quantization unit 13 sets a frame of number (M+1) as the leading frame (first frame) of the next frame block and a frame of number M as the second frame. The quantization unit 13 determines the current frame block to be made up of frames from number (LN+1) to number M. That is, frames from the first frame to the second frame are set belonging to the current frame block (step S515).

Next, the quantization unit 13 assigns difference values C(LN+1)+ . . . +C(M) to S2 as information for new difference values (step S517).

Then, the quantization unit 13 clears the buffer unit 7 (step S518). Next, a value of 1 added to LN is assigned to audio data number i (step S519).

Then, the quantization unit 13 retrieves the i-th audio data piece which has been filtered from the intermediate buffer 14 and re-quantizes it. As is the case for the first embodiment, if dividing audio data number i by the number of successive frames in a cycle D yields a remainder of "1", the quantization unit 13 quantizes the audio data by adjusting the quantization scale so that the amount of quantized data does not exceed the capacity A of the main data field in a frame of number i. If dividing audio data number i by the number of successive frames in a cycle D yields a remainder that is not "1", the quantization unit 13 quantizes the audio data by adjusting the quantization scale so that the amount of quantized data does not exceed a total (A+B) of the capacity A of the main data field in a frame of number i and the sum in size of empty portions of main data fields in one or more given frames preceding the frame of number i or a predetermined upper limit which is smaller (B). For example, if a difference value (i+1) is positive and a difference value C (i) is negative, the size B that is available for the i-th data piece is increased within the upper limit and the increased size is deducted for the (i+1)-th data piece. Or, the size B appropriate for each frame number is controlled so that there will be no negative amount of allocation for audio data numbers from LN+1 to M or a negative amount of allocation will be compensated by all positive amounts of allocation depending on the difference value C. Here, the above-mentioned one or more given frames are a frame for which dividing its frame number by the number of successive frames in a cycle D yields a remainder of "1" and frames ranging from a frame number (i−D) to a frame number (i−1). Moreover, in this example of modification, the quantization unit 13 performs re-quantization by adjusting the quantization scale based on the difference sum value S2, so that an empty portion of a data field, as described for the first embodiment, is not produced (step S520).

Then, the quantization unit 13 stores the re-quantized audio data into the buffer unit 7 as main_data (i) (step S521).

Then, the quantization unit 13 generates a header and additional information for main_data (i) and provides these to the stream generating unit 15. Here, if i is (LN+1), the quantization unit 13 sets main_data_begin (j), which is a part of additional information, to "0". If i is not (LN+1), the quantization unit 13 assigns the length between the beginning of the frame of number in the stream and the beginning position of main_data (i) (excluding additional information and a header) to a value of main_data_begin (i) which is a part of additional information. Also, the quantization unit 13 provides information as to how much portion of main_data (i)

should be put in each frame preceding the frame of number i (allocation information) to the stream generating unit 15 (step S522).

Audio data number i is incremented by one (step S524) until audio data number i becomes M (YES as decided at step S523) and the process from step S520 is repeated.

A procedure for processing one frame block by the stream generating unit 15 of the audio encoding apparatus according to this example of modification is the same as in the second embodiment and, therefore, its description is not repeated.

Third Embodiment

The difference of a third embodiment from the first embodiment lies in the quantization unit 3.

In the first embodiment, as for frames that exist cyclically as the first one of a given number of successive frames, the quantization unit 3 quantizes corresponding audio data by adjusting the quantization scale so as not to exceed the capacity A of the main data field of a fixed length.

On the other hand, in the present embodiment, as for frames that exist cyclically as the first one of a given number of successive frames, the quantization unit 3 varies the size of the main data field, i.e., the size of the frame, instead of adjusting the quantization scale so as not to exceed the default capacity A of the main data field. Thereby, even if the amount of quantized audio data has exceeded the default capacity, the quantized audio data can be accommodated in the frame, because the size of the main data field is increased.

Figure 12:
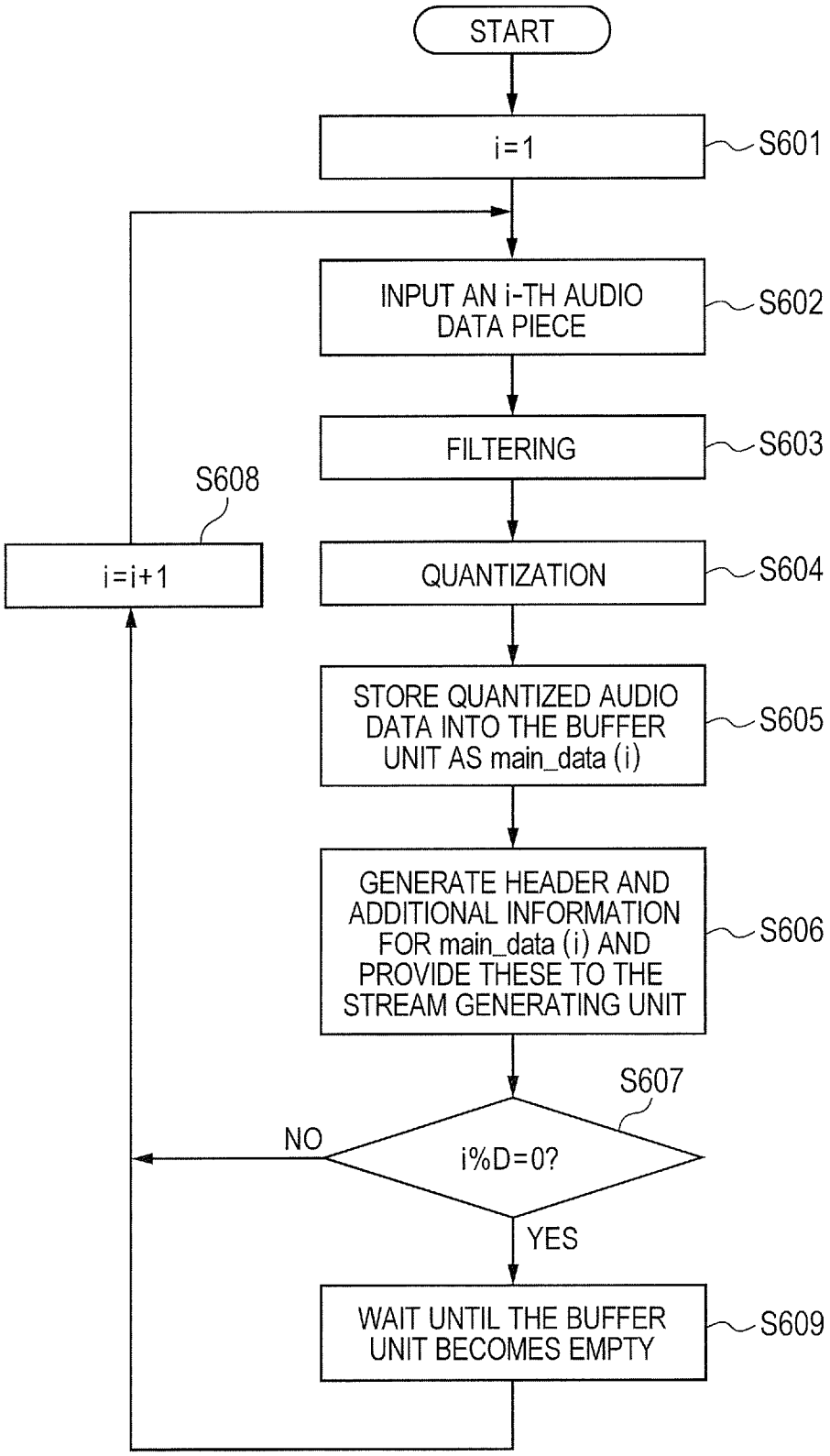
FIG. 12 is a flowchart illustrating an operation procedure of the filtering unit and quantization unit of the audio encoding apparatus according to a third embodiment.

FIG. 12 is a flowchart illustrating an operation procedure of the filtering unit and quantization unit of the audio encoding apparatus according to the third embodiment.

Referring to FIG. 12, first, audio data number i is set to "1" (step S601).

Then, an audio data piece of number i is input to the filtering unit 2 (step S602).

Then, the filtering unit 2 performs filtering (step S603). Next, the quantization unit 3 quantizes filtered audio data. Specifically, if dividing audio data number i by the number of successive frames in a cycle D yields a remainder of "1", the quantization unit 3 quantizes the audio data without regard to whether the amount of quantized data exceeds the capacity A of the main data field in a frame of number i. Otherwise, if dividing audio data number i by the number of successive frames in a cycle D yields a remainder that is not "1", the quantization unit 3 quantizes the audio data by adjusting the quantization scale so that the amount of quantized data does not exceed a total (A+B) of the capacity A of the main data field in a frame of number i and the sum in size of empty portions of main data fields in one or more given frames preceding the frame of number i or a predetermined upper limit which is smaller (B). Here, the one or more given frames are a frame for which dividing its frame number by the number of successive frames in a cycle D yields a remainder of "1" and frames ranging from a frame number (i−D) to a frame number (i−1) (step S604).

Then, the quantization unit 3 stores the quantized audio data into the buffer unit 7 as main_data (i) (step S605).

Then, the quantization unit 3 generates a header and additional information for main_data (i) and provides these to the stream generating unit 5. Here, if dividing audio data number i by the number of successive frames in a cycle D yields a remainder of "1", the quantization unit 3 sets main_data_begin (j), which is a part of additional information, to "0". If dividing audio data number i by the number of successive frames in a cycle D yields a remainder that is not "1", the quantization unit 3 assigns the length between the beginning of the frame of number i in the stream and the beginning position of main_data (i) (excluding additional information and a header) to a value of main_data_begin (i) which is a part of additional information. Also, the quantization unit 3 provides information as to how much portion of main_data (i) should be put in each frame preceding the frame of number i (allocation information) to the stream generating unit 5 (step S606).

Next, if dividing audio data number i by the number of successive frames in a cycle D yields a remainder of "0" (YES as decided at step S607), the process waits until the buffer unit 7 becomes empty, when the buffered audio data has been consumed by the stream generating unit 5 (step S609). After that, audio data number is incremented by one (step S608) and the process from step S602 is repeated.

Otherwise, if dividing audio data number i by the number of successive frames in a cycle D yields a remainder that is not "0" (NO as decided at step S607), audio data number i is incremented by one (step S608) without waiting until the buffer unit 7 becomes empty and the process from step S602 is repeated.

Figure 13:
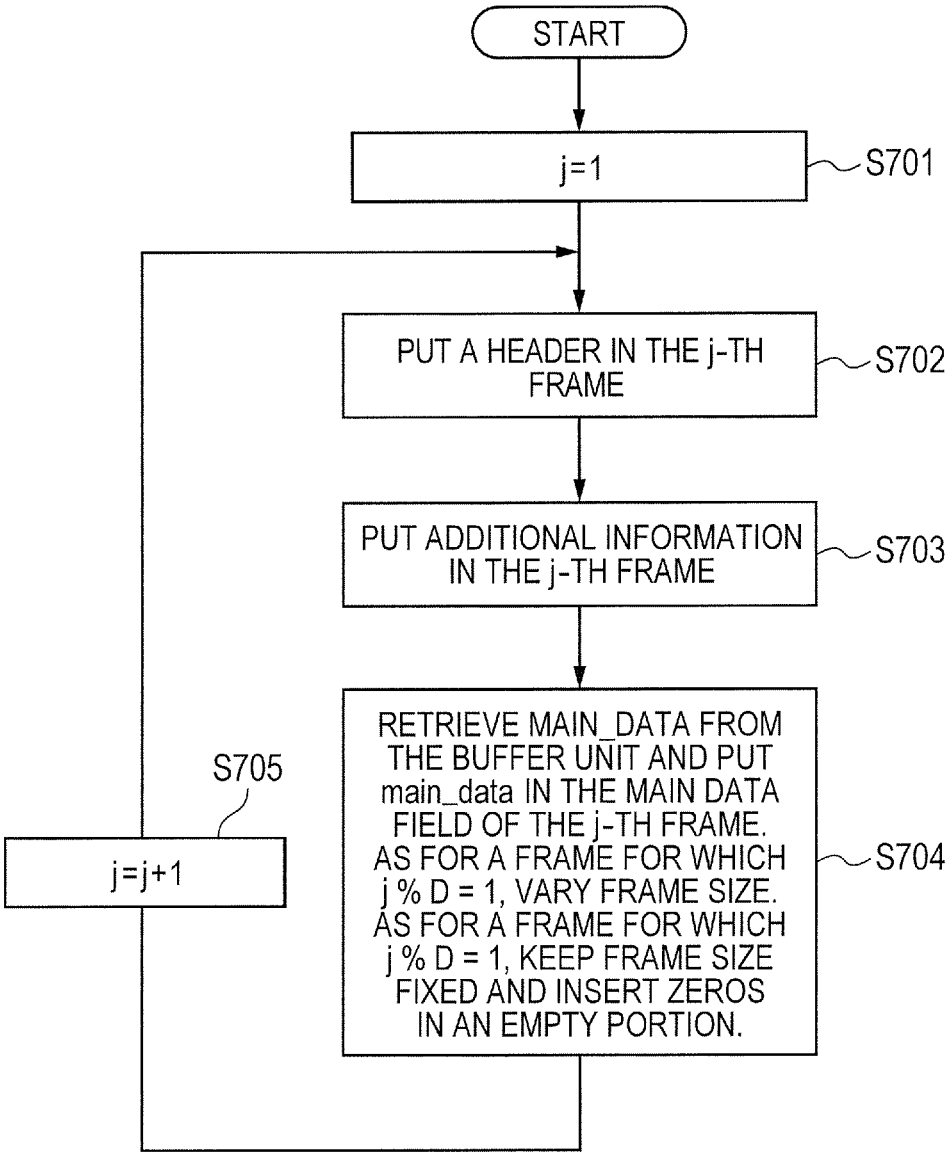
FIG. 13 is a flowchart illustrating an operation procedure of the stream generating unit of the audio encoding apparatus according to the third embodiment.

FIG. 13 is a flowchart illustrating an operation procedure of the stream generating unit 5 of the audio encoding apparatus according to the third embodiment.

First, frame number j is set to "1" (step S701). Then, the stream generating unit 5 puts a header for main_data (j) created by the quantization unit 3 in a header field of the frame of number j (step S702).

Then, the stream generating unit 5 puts additional information for main_data (j) created by the quantization unit 3 in an additional information field of the frame of number j (step S703).

Then, based on allocation information created by the quantization unit 3, the stream generating unit 5 retrieves main_data as much as the capacity A of a main data field of the frame of number j from the buffer unit 7 and puts the main_data in the main data field. With regard to a frame for which dividing frame number j by the number of successive frames in a cycle D yields a remainder that is not "1", the stream generating unit 5 extends or reduces the frame size so that the frame has the main data field enough to accommodate the amount of main_data (j). As for a frame for which dividing frame number j by the number of successive frames in a cycle D yields a remainder of "1", the stream generating unit 5 keeps the frame size fixed and, if there remains an empty portion in the main data field, pads the empty portion with zeros (zero padding) (step S704).

Next, frame number j is incremented by one (step S705) and the process from step S702 is repeated.

Figure 14:
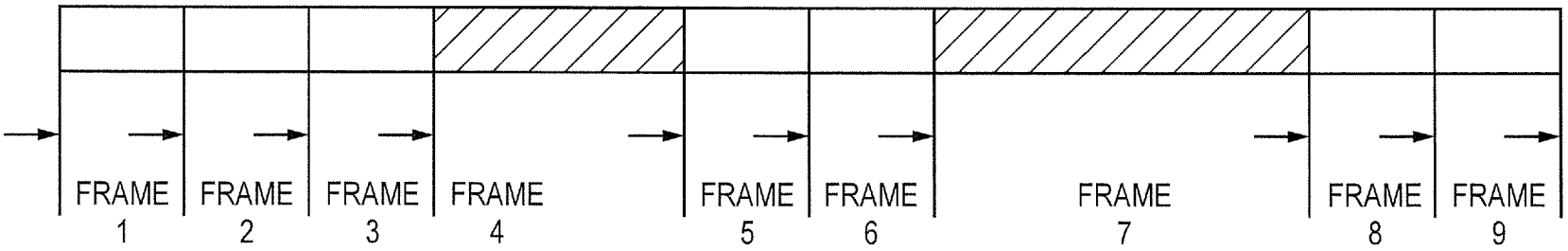
FIG. 14 is a diagram showing an example of a stream that is generated by the audio encoding apparatus according to the third embodiment.

(Stream example) FIG. 14 is a diagram showing an example of a stream that is generated by the audio encoding apparatus according to the third embodiment.

As shown in FIG. 14, this diagram shows a stream example in a case where the number of successive frames in a cycle D is "3". As for frame 1, because the amount of main_data (1) does not exceed the default capacity A of the main data field, the frame length remains at default and is unchanged. Main_data (1) is put in the main data field having the default capacity A and main_data (2) and subsequent data are put in the remaining part of the main data field.

On the other hand, as for frame 4, because the amount of main_data (4) exceeds the default capacity A of the main data field, the frame length is extended from the default and main_data (4) is put in the extended main data field.

As for frame 7, because the amount of main_data (7) exceeds the default capacity A of the main data field, the frame length is extended from the default and main_data (7) is put in the extended main data field.

As above, in the present embodiment, by varying the length of a frame in which main_data_begin is 0, it is possible to prevent that the quality of audio data in that frame degrades.

The embodiments disclosed herein are to be considered in all respects as illustrative and not restrictive. The scope of the present invention is indicated by the appended claims, rather than by the foregoing description, and all changes which come within the meaning and range of equivalency of the claims are therefore intended to be embraced therein.

What is claimed is:

1. An audio encoding apparatus comprising:

a quantization unit that quantizes audio data into a plurality of audio data pieces;

a buffer unit that buffers the audio data pieces; and a stream generating unit that puts the audio data pieces from said buffer unit into a plurality of frames in a stream of the audio data, wherein said stream generating unit divides the frames in the stream into frame blocks, each of the frame blocks including an odd number of the frames, and sets a leading frame of one of the frame blocks as a predetermined frame, wherein, among a first frame which is next to a last frame of a previous frame block and a given number of subsequent frames, said quantization unit sets a frame for which a size of quantized audio data related to a header included in the frame is smallest as a next predetermined frame that should exist in the next frame block, wherein said quantization unit determines a frame that precedes the predetermined frame as a second frame and sets frames from the first frame to the second frame as the current frame block, wherein, in a main data field of the predetermined frame, said stream generating unit puts an entire one of the audio data pieces related to a header of the predetermined frame and puts at least part of one or more audio data pieces following the entire one of the audio data pieces in a remainder of the main data field of the predetermined frame, wherein, in a main data field of a frame following the predetermined frame, said stream generating unit puts at least another part of one or more audio data pieces following the entire one of the audio data pieces.

2. The audio encoding apparatus according to claim 1, wherein said stream is a MPEG Audio Layer 3 stream and said stream generating unit puts information in the header of said predetermined frame indicating that the entire first one of the audio data pieces is in the predetermined frame.

3. The audio encoding apparatus according to claim 1, wherein said stream generating unit varies a length of said main data field of said frames.

4. The audio encoding apparatus according to claim 1, wherein all frames in said stream are of a fixed length and said stream generating unit pads an empty portion of said frames not filled with the audio data pieces within the main data field thereof with zeros.

5. The audio encoding apparatus according to claim 1, wherein all frames in said stream are of a fixed length and said quantization unit adjusts a quantization scale of the audio data so that no empty portion is produced in the main data field in the frames following the predetermined frame.

6. An audio encoding apparatus comprising:

a quantization unit that quantizes audio data into a plurality of audio data pieces;

a buffer unit that buffers the audio data pieces; and a stream generating unit that puts the audio data pieces from said buffer unit into a plurality of frames which each include a header related to the audio data pieces in a stream, wherein, as for a predetermined frame, said stream generating unit puts in a data field of the frame the whole of an audio data piece related to a header included in that frame and puts audio data pieces following that audio data piece in a remaining part of the data field of the frame and, as for a frame other than the predetermined frame, said stream generating unit puts in a data field of the frame an audio data piece related to a header included in that frame and/or audio data pieces following that audio data piece, wherein said stream generating unit divides frames in a stream into frame blocks, each frame block including an uneven number of frames, and sets the leading frame of one frame block as said predetermined frame, wherein said quantization unit sets the origin of a block at a first frame which is next to the last frame of the previous frame block and sequentially selects subsequent frames and calculates a difference between the capacity of a main data field in a frame and the amount of quantized audio data related to a header included in the selected frame, and wherein said quantization unit determines a frame for which the sum of differences accumulated for sequentially selected frames will exceed the capacity of said buffer unit as a predetermined frame that should exist in the next frame block and sets frames from the first frame to the second frame as the current frame block.

7. A method of encoding audio data comprising:

quantizing audio data into a plurality of audio data pieces;

buffering the audio data pieces;

placing the audio data pieces into a plurality of frames in a stream of the audio data, wherein the frames in the stream are divided into frame blocks, each of the frame blocks including an odd number of the frames, and a leading frame of one of the frame blocks is set as a predetermined frame, wherein, among a first frame which is next to a last frame of a previous frame block and a given number of subsequent frames, a frame for which a size of quantized audio data related to a header included in the frame is smallest is set as a next predetermined frame that should exist in the next frame block, wherein a frame that precedes the predetermined frame is set as a second frame and frames from the first frame to the second frame are set as the current frame block, wherein an entire one of the audio data pieces related to a header included in the predetermined frame and at least part of one or more audio data pieces following the entire one of the audio data pieces in a remainder of the main data field of the predetermined frame are placed in a main data field of the predetermined frame, and wherein, in a main data field of a frame following the predetermined frame, at least another part of one or more audio data pieces following the entire one of the audio data pieces is placed in the main data field of the frame following the predetermined frame.

8. The method of encoding audio data according to claim 7, wherein said stream is a MPEG Audio Layer 3 stream, and $main_{13}$ $data_{13}$begin that represents "0" is placed in said predetermined frame.

9. The method of encoding audio data according to claim 7, further comprising:

varying a length of said main data field of said frames.

10. The method of encoding audio data according to claim 7, wherein all frames in said stream are of a fixed length, and an empty portion of said frames not filled with the audio data pieces within the main data field thereof are padded with zeros.

11. The method of encoding audio data according to claim 7, wherein all frames in said stream are of a fixed length and a quantization scale of the audio data is adjusted so that no empty portion is produced in the main data field in a frame following the predetermined frame.

* * * * *